US005410838A

United States Patent [19]

O'Leary et al.

[11] Patent Number: 5,410,838

[45] Date of Patent: May 2, 1995

[54] TREE STAND CONTAINER

[76] Inventors: Phyllis C. O'Leary; Michael F. O'Leary, both of 79 Seward St., San Francisco, Calif. 94114

[21] Appl. No.: 981,872

[22] Filed: Nov. 25, 1992

[51] Int. Cl.[6] ..... A47G 7/02

[52] U.S. Cl. ..... 47/40.5; 206/423; 206/557

[58] Field of Search ..... 47/40.5, 41.11, 41.12; 206/423, 557; 248/27.8; 220/524, 525, 501

[56] References Cited

U.S. PATENT DOCUMENTS

| | | | |
|---|---|---|---|
| D. 229,597 | 12/1973 | Wastal . | |
| D. 242,406 | 11/1976 | Romanoff . | |
| 256,806 | 4/1882 | Markland | 220/524 |
| 1,344,526 | 6/1920 | Tilney | 47/41.11 |
| 1,354,211 | 9/1920 | Reed | 220/524 |
| 2,701,699 | 2/1955 | Chapin . | |
| 2,892,540 | 6/1959 | Tupper . | |
| 2,930,162 | 3/1960 | Mulford | 47/79 |
| 3,009,291 | 11/1961 | Blackmore | 206/423 |
| 3,661,350 | 5/1972 | Eckler et al. | 248/311.2 |
| 3,784,136 | 1/1974 | Lopez . | |
| 4,412,616 | 11/1983 | Williams | 220/524 |

FOREIGN PATENT DOCUMENTS 892899 4/1962 United Kingdom .

*Primary Examiner*—Ramon S. Britts
*Assistant Examiner*—Joanne C. Downs
*Attorney, Agent, or Firm*—Kathleen A. Skinner

[57] ABSTRACT

A tree stand container for holding water for a cut tree which is mounted on a tree base of horizontal support members. The container has a plurality of integrally connected container segments extending radially from a central portion. The container segments have a generally horizontal bottom surface and side walls extending generally vertically from the bottom surface. The side walls of the container segments are coextensive with, and define, the exterior side walls of the container. The container forms a top opening to receive a tree base and to maintain the base and the lower end of a cut tree in water.

15 Claims, 3 Drawing Sheets

TREE STAND CONTAINER

RELATED APPLICATION

There is a co-pending application Ser. No. 07/900,979, filed Jun. 18, 1992, for the design of a tree stand container.

BACKGROUND OF THE INVENTION

1. Field of the Invention

The present invention relates to tree stands for cut trees and, particularly, to containers for holding a Christmas tree and the tree stand to which it is mounted in water.

2. Description of the Prior Art

There are a number of ways in which people maintain a cut Christmas tree during the holiday season. Although cut trees may be stored for sale in stacks or leaning against walls, it is difficult for purchasers to view the trees for purchase if the trees are not separately displayed in an upright position. Many Christmas tree lot managers therefore nail a simple wooden cross to the bottom end of the tree trunk to hold it upright. A purchaser may then take such a tree home and decorate it and display it while still supported by the wooden cross. While this option is most convenient, it has drawbacks, since a cut tree trunk exposed to air, especially the air in a heated home, will quickly dry out, lose its fragrance, drop its needles and become a serious fire hazard, particularly if decorated with electric lights. One way to avoid these disadvantages and extend the life of the tree is to place the tree in water so that it can absorb moisture and remain lifelike for a longer time. Thus, many tree purchasers remove the wooden cross from the tree trunk, cut off some of the lower branches and place the tree in a bucket or in a special tree stand which holds water. Many such containers have a central basin with radially adjustable screws or the like for anchoring different-sized tree trunks in a level upright position in the water. U.K. Pat. No. 892,899 illustrates a tree container with a central holding mechanism. However, in using such a device, considerable adjusting and branch trimming are usually required before the tree will be supported levelly for decorating.

There have been attempts in the art to reduce the risk of fire while utilizing the wooden tree stand on which the tree was mounted at the time of purchase. One such device is shown in U.S. Pat. No. 3,784,136. This circular basin, which is large enough to accommodate an entire tree stand, would require a great deal of water and take up considerable space under a tree. U.S. Des. Pat. No. 229,597 also shows a container which appears to be capable of holding a wooden cross tree stand. The total base of this design is very large, however, and would also take a great deal of water if the entire square base is filled with water. It appears that this is a multi-leveled stand and that the cross-design opening is supported inside the square base with ribbing or the like surrounding the cross portion and extending between each leg of the cross. It is expected that the construction of this unit would be relatively complex and that it would be difficult to cover this device.

Neither of these prior art forms which accommodate the entire tree stand allow for leveling once the tree has been placed into position, and water added, and most particularly after decorating the tree, without forcing the user to add shims to the support members of the stand which are under water inside the basin. This can become a very messy proposition and is even more difficult and awkward if the tree has already been decorated before any out-of-plumb condition is recognized. If a tree is not stable in its upright position, in addition to appearances, there is also a risk that the entire tree may tip over and damage possibly valuable ornaments and surroundings.

It has been shown that a cut tree will absorb a substantial amount of water soon after it has been cut, as much as one gallon. Since the water will need to be replenished periodically, it is necessary that the tree stand container be accessible from beneath the tree for refilling. With many tree containers, the branches and presents make the container difficult to refill. There is also a need to prevent evaporation of the water in the tree stand container, to prevent pets and young children from drinking it, since the water may contain chemicals to extend the life of the tree or reduce algae, and to prevent presents and decorations from falling into it. U.S. Pat. No. 3,784,136 illustrates a circular lid which fits tightly about the trunk of the tree to trap the water with the expectation that it will not be necessary to refill the basin. This lid is constructed to close around the trunk with fasteners which have to be reached under the tree. U.K. Pat. No. 892,899 also discloses a lid for a basin which is fitted around the tree and anchored by adhesive to the basin, leaving a hole for refilling purposes. Neither of these lids can be easily moved or removed for replenishing the water without disturbing the tree or its decorations.

Thus, none of the prior art provides a tree stand container which can securely hold the tree and its horizontal stand in water, which may be manufactured relatively easily, which has segments which extend out from the tree and can be individually fitted with lids, which can be reached easily and removed without disrupting the tree or disturbing the presents and which allows ease of leveling under the flexible segments, even after a tree is decorated. The present invention provides a solution to these needs; it provides a tree stand container that holds a substantial amount of water, one which will hold the tree mounted on its tree stand, one which allows ease of leveling at any stage of tree decorating, and one which can be fitted with easily removable lids.

SUMMARY OF THE INVENTION

The present invention is a container for a tree which is mounted on a base of horizontal support members. The container has a plurality of container segments extending radially from a central portion of the container, each of the container segments having a horizontal bottom surface and generally vertical side walls which extend upwardly from the bottom surface. The exterior walls of the container segments are coextensive with the exterior walls of the container itself and the container has a top opening to receive a tree base formed from horizontal support members and to maintain the base and the lower end of a cut tree in water.

Removable lids may be placed on the upper end of the side walls of each segment to reduce evaporation of the water and to prevent access to the water in the container by pets and children. The lid on any one segment may be easily removed to allow access to the container for checking or refilling the water level with minimal disturbance of the tree decorations and presents.

The number and shape of the container segments may be selected to accommodate different-shaped horizontal support members and to allow different container designs. The invention may also include horizontal support members for the tree stand, constructed to correspond to the design of the container of this invention.

Thus, it is an object of this invention to provide a container with radially extending segments into which a cut tree, already mounted and leveled on a tree stand, can be placed so that both the tree and the stand will be maintained in water. It is another object of the invention to provide a container for a tree stand capable of holding sufficient water to avoid the need for continual refilling, and which provides easily reachable segments projecting out from under the tree without the whole container taking up a great deal of space under the tree.

It is yet another object of the invention to make the installation of a Christmas tree as convenient as possible, by providing a container which accepts the conventional wooden tree stand or the molded tree stand specially adapted for the container, thereby making leveling unnecessary in most cases, or if leveling should be desired, by allowing the user to level the tree by providing a shim to one of the container segments. It is a further object of the invention, in one embodiment, to provide easily removable and replaceable lids to cover the container segments to prevent evaporation of the water, access by pets, unwanted spilling and accidental soaking of ornaments.

This invention therefore provides a device with an attractive design, relatively easy to manufacture, which will receive a tree stand, either a conventional wooden tree stand or one especially designed for the container, attached to the trunk of a cut tree and the container will hold both the stand and the tree in water. This invention thus reduces fire hazards and extends the life and beauty of a cut tree, but without the need for time-consuming adjustments to level the tree and, in most instances, it eliminates tree stand installation entirely. This tree stand container can also be used with tree stands having non-wooden horizontal support members which are manufactured to fit the container of this invention.

Other advantages and objects of the invention will become apparent when it is considered in conjunction with the accompanying drawings.

DESCRIPTION OF THE PREFERRED EMBODIMENT

Figure 1:
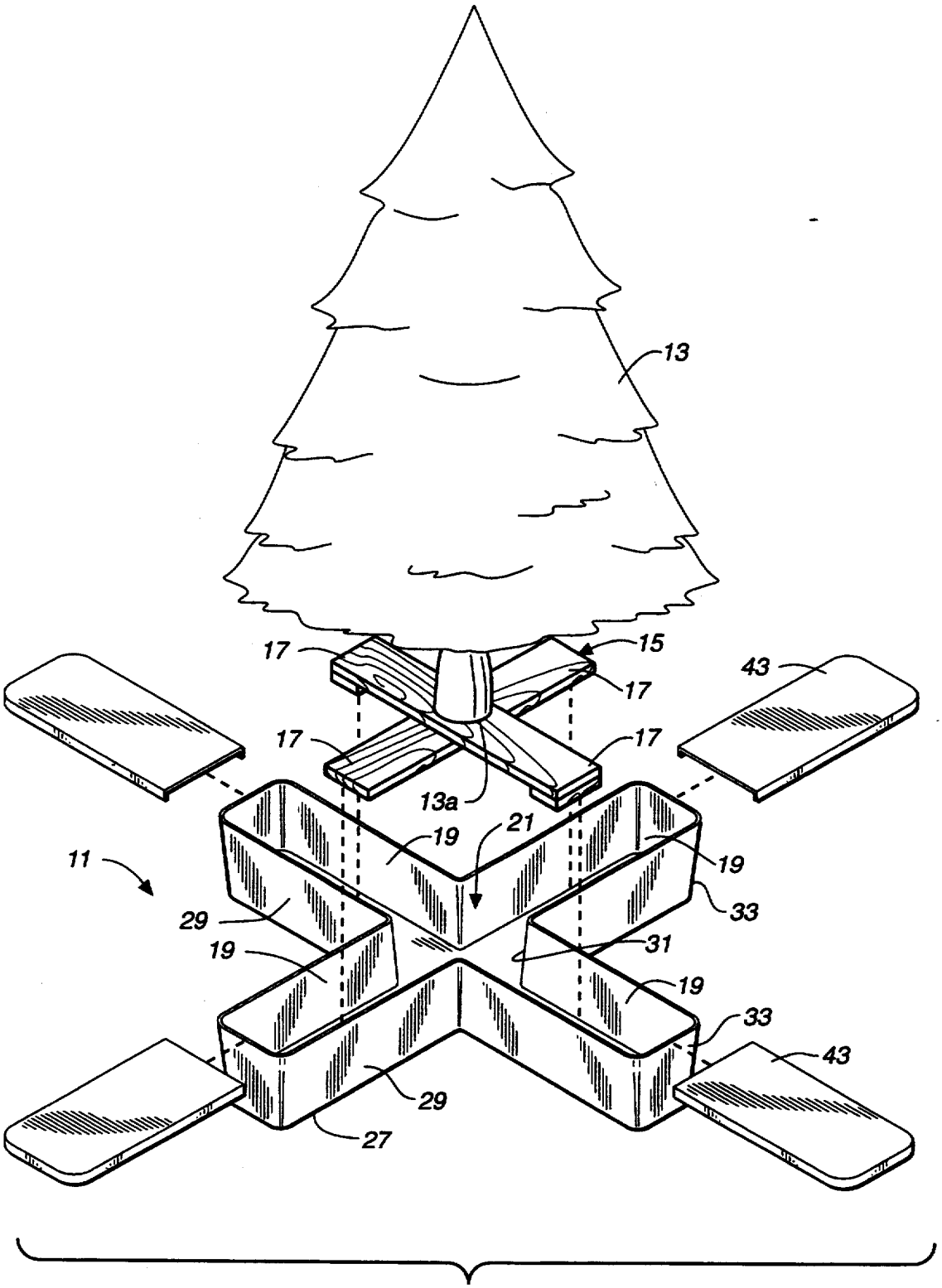
FIG. 1 is a perspective view of one embodiment of the tree stand container of this invention illustrating the insertion of a tree and tree stand.

The present invention is a container 11 for holding water for a cut tree 13 when the tree is maintained in an upright position within the container by a base 15 having horizontal support members 17 mounted on the lower end 13*a* of the tree. The container comprises a plurality of container segments 19 extending radially from a central portion 21 of the container. The container of this invention has a top opening for receiving and holding the horizontal members forming the base of the tree stand.

Figure 4:
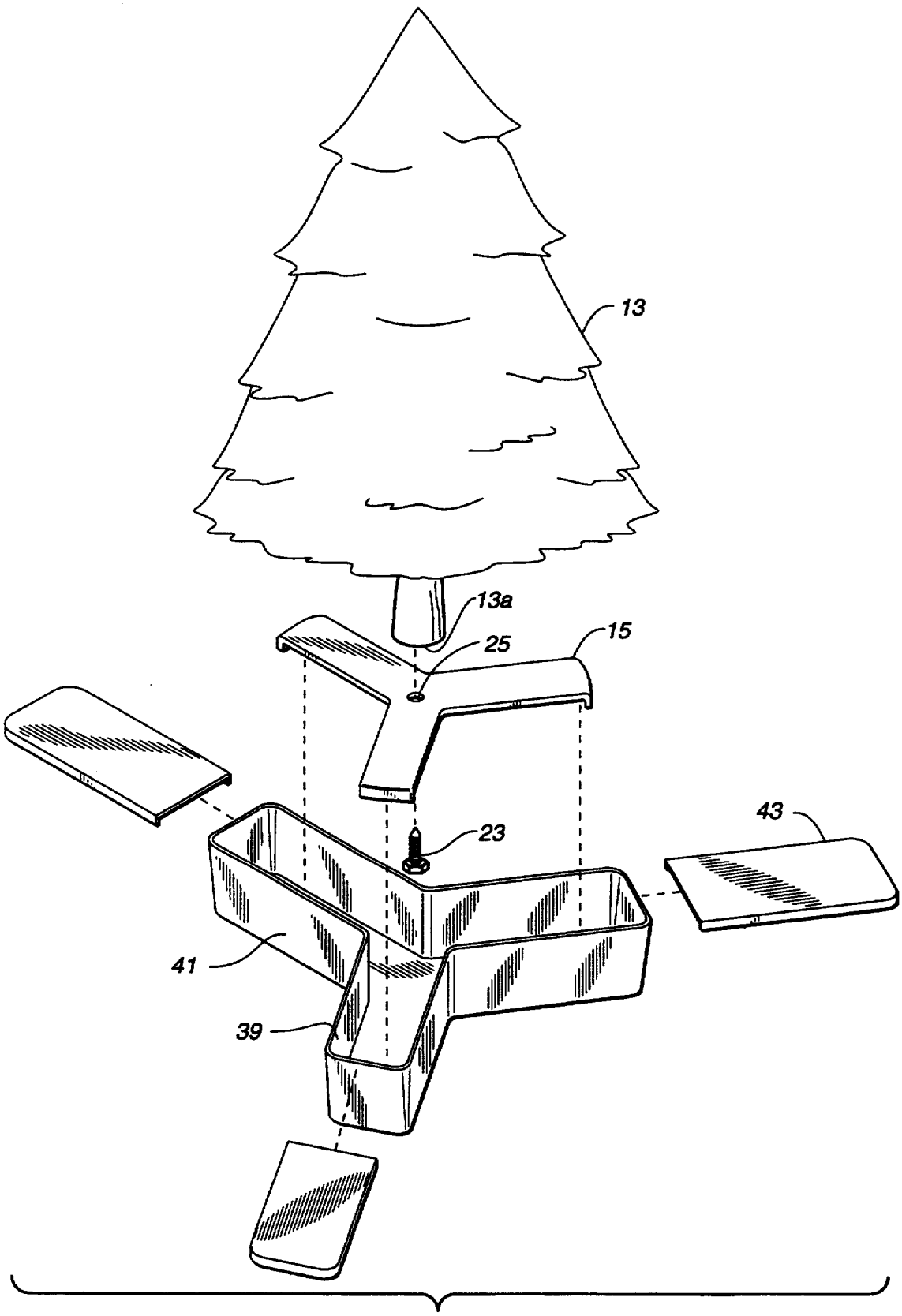
FIG. 4 is a perspective view of another embodiment of the tree stand container with a corresponding tree stand.

The horizontal support members 17 used for the tree base 15 are typically a cross-shaped wooden stand which is, in many cases, provided free of charge with a Christmas tree. The wooden stand may be made from a divided piece of two-by-four lumber which is nailed or screwed onto the lower end of the tree trunk along the cut surface 13*a* of the tree. The horizontal support base 15 may instead be a one-piece molded plastic unit having a plurality of horizontal support members, which is designed to be bolted or nailed onto the cut portion of the tree and then placed into the tree stand container of this invention, as seen in FIG. 4. A molded plastic tree stand 15 may be preferred in very cold areas where wooden tree stands freeze to the ground when set. A molded tree stand would offer versatility in that it could be made with three radially extending members, or more than four, if desired. A secure fastening means could be provided in a preferred version of this support base, with a locking bolt or screw 23 designed to be inserted from the underside of the base through hole 25 disposed in the center of the tree base and anchored into a predrilled hole in the bottom 13*a* of the cut tree 13.

The tree stand container 11 of this invention preferably has at least three container segments 19 and, while it may have any number, for many applications, the container has four container segments. Each of the container segments has a generally horizontal bottom surface 27 and side walls 29 extending generally vertically upwardly from the bottom surface. The side walls of the container segments are coextensive with the exterior side walls of the container itself. The side walls are generally continuous except for a vertical opening on one end of the segment. The container segments are integrally attached to each other proximate these open ends at junction 31 so that the segments form one integral container 11 with an open central portion 21 and spoke-like radial segments 19, the container providing a top opening shaped to correspond to the shape of a preselected tree stand 15. The horizontal bottom surface of each container segment is also coextensive with the bottom surface of the container. In the preferred embodiment, it is constructed of one piece and integrally connected to the vertical side walls of the radially extending container segments.

Figure 3:
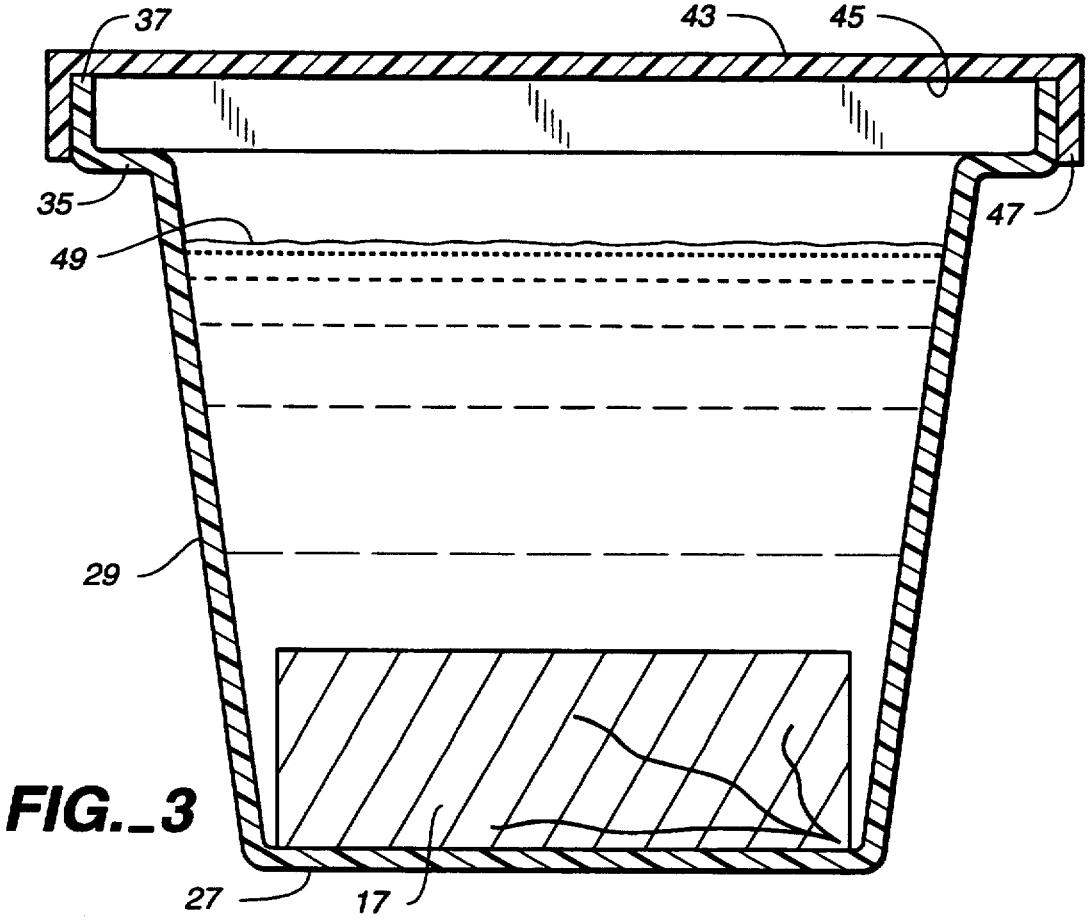
FIG. 3 is a cross-sectional view taken along line 3—3 of FIG. 2.

In one embodiment, the container has four container segments 19 which are generally rectangular in shape and when joined together form a cross-shaped top opening. The shape of the container segments can be varied for other designs. They could be rounded somewhat at their outer ends 33 and at their junction 31 or the container segments could be shaped to form a Celtic cross in plan view. The container segments could be formed in any shape which, when joined to form the container, would receive a plurality of horizontal support members. For ease in nesting of the tree stand containers, the side walls 29 of the container segments can be tapered outwardly from the bottom to the top, as seen in FIG. 3. For additional rigidity the upper end of the side walls could also include a strengthening rib or an inwardly projecting shelf 35 which has a vertically upward portion 37 to mate with a lid 43. In one embodiment, the side walls and bottom surface of the container may be a uniform thickness. The side walls are generally continuous and solid and formed from a single piece, so that it is seamless and watertight. However, in another embodiment (not shown), the side walls 29 could be formed from a lattice structure having a basket appearance, for example. For such a container, an inner watertight liner, which could be flexible and removable, would be secured inside the container.

The side walls 29 of the container segments 19 are coextensive with the exterior side walls 29 of the tree stand container 11. In this invention, the container segments and the central open portion 21, created when the segments are joined near their open ends, form the container itself and provide the shape to the container, unlike tree stand containers of the prior art which have an additional base with outer walls. The container segments can be shaped to correspond generally to the shape of the tree stand upon which the tree is mounted, so that it will present a neat appearance under the tree and will disguise the roughness of a wooden cross stand, but will still hold substantial amounts of water for the tree. The exterior surfaces 41 of the walls of the container may be colored or treated with any ornamentation or surface texture desired for special effect; for instance, the exterior surface could include an irregular texture resembling cut glass. Generally, the inner surface 39 of the container will be smooth enough to permit the unobstructed insertion of the tree stand.

The horizontal bottom surface 27 of the container 11 generally corresponds in shape with the top opening of the container and is a continuous element, formed in part by the horizontal bottom surface 27 of the container segments 19. The bottom surface is generally flat so that it will be level on a floor or table. It may also have ribs of any design (not shown) added symmetrically to the exterior surface of the bottom for additional integrity and to provide a spacing means between stacked containers. If the tree 13 should be mounted on its tree stand 15 in a nonlevel manner, one leg of the tree stand or the tree stand container can be easily shimmed by a small object. This method of leveling is far simpler than making the necessary readjustments of a tree which is inserted without a tree stand directly into a container and anchored by radial prongs.

Figure 2:
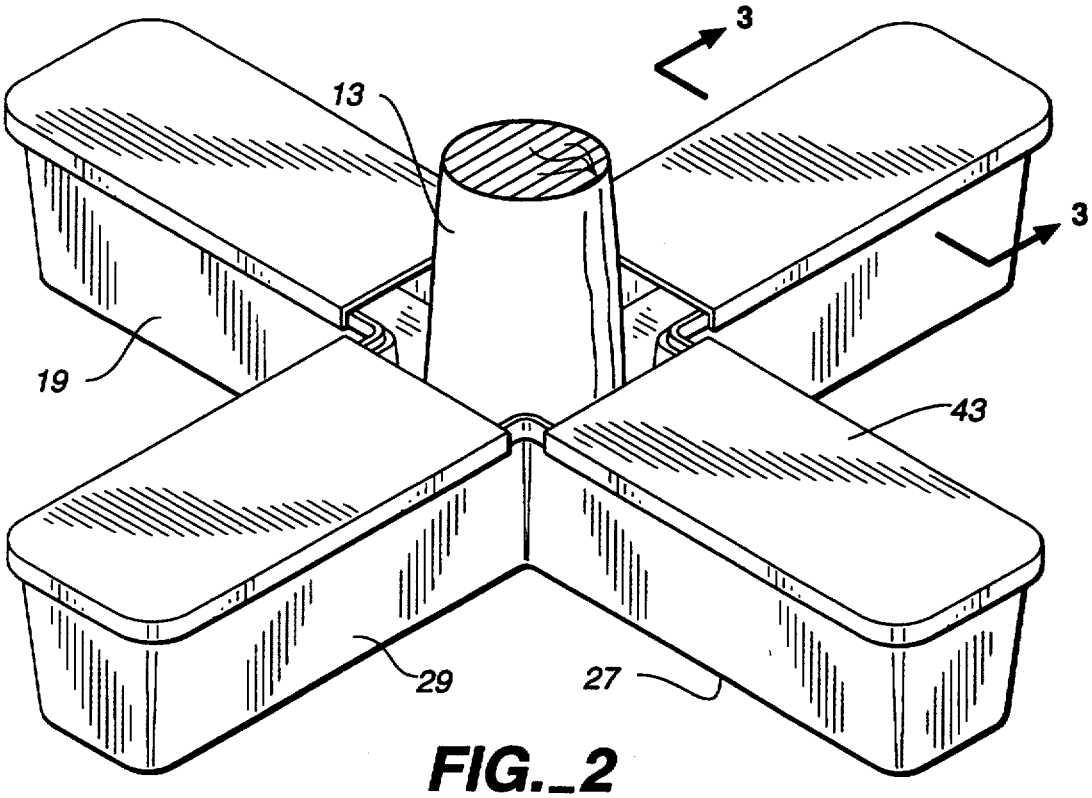
FIG. 2 is a perspective view of another variation of the tree stand container with the upper end of a tree cut away.

The tree stand container 11 of this invention is preferably used with lids 43 which are removably disposed on the upper end 37 of the side walls 29 of each container segment 19. The lid 43 may have an inner top surface 45 with a width approximately equal to the outer width of the top opening formed by the side walls of the container segment so that the lid will closely cover the top opening of the segment. The lid may have a flange 47 depending downwardly along the outer edges of the top surface 45 of the lid so that the flange will cover and extend below the tops of the side walls of the container segment and be secured thereon. The lid of this invention may be snapped on or slid onto the upper end 37 of the side walls of the segment to fit snugly thereon. Alternatively, the lid could be secured by fitting it into a groove or shelf 35 disposed on the upper end of the side walls of the container segment. The lids need not be smooth and could be decorated or treated with a texture design, as described above for the exterior walls 11 of the container. The lid is of a length corresponding generally to the length of the container segment from the outer end 33 of the segment to the central portion 21 of the container, as illustrated in FIG. 2. Thus, as can be seen in FIG. 2, most of the tree stand container surrounding the tree trunk is covered so that little water will be lost to evaporation, access by pets is limited, and presents or decorations accidentally dropped under the tree will not get wet. Yet, if additional water is needed by the tree, the lid of one segment can be slid or popped off, water can be added as needed, and the lid can be replaced quite easily.

The tree stand container 11 and the lid 43 of this invention, in the embodiment illustrated in the drawings can be advantageously manufactured from plastic by injection molding. In the preferred embodiment, for a relatively large tree, the side walls 29 of the container are preferably 5 inches (12.7 cm.) high, and the container segment is preferably 16 inches (40.64 cm.) long, from the central portion 21 to the outer end 33. This sized container is sufficient for a relatively large tree and provides a volume sufficient to hold the tree stand in 3 to 4 gallons of water with the water line 49 close to the top of the container. Since a cut tree may absorb as much as one gallon of water within the first 24 hours of being immersed in the water, this tree stand container is one of the few that will supply the necessary water without initial refilling. The tree stand container and its lid may be made from clear or translucent plastic, if it is desired to visually monitor the water level at all times, or it can be opaque to disguise the stand, or it can be colored or covered with stickers, or the like. Since the tree stand container will preferably be manufactured of somewhat flexible plastic, leveling of the tree and tree stand can be accomplished simply by shimming the individual segments, even after water has been added. The side walls and bottom are desirably at least 1/16 inch (1.58 mm.) thick to be sturdy enough to withstand the pressure of this volume of water. Obviously, the size of the tree stand container can be varied to accommodate different sized trees and different lengths of supporting members 17 of the tree stand 15. It should be noted that the vast majority of free wooden stands which accommodate a six-to-ten foot tree will easily fit within the preferred dimensions described above. Those wooden stands are generally made from a single piece of two-by-four lumber, approximately 28 inches in length, split diagonally with a circular cut. Sometimes two-by-two lumber is utilized as shown in FIG. 1. The support members for trees six-to-eight feet tall are usually 14 inches long. Larger support members can simply be trimmed to fit the dimensions of the tree stand container.

The tree stand container 11 of this invention could also be manufactured in components which may be securely attached to each other at the time of use. Such a container could be disassembled for storage and reuse. A flexible, watertight inner liner could be used with such a container to insure that there would be no leakage through the assembled container. The tree stand container could also be made of inflatable material to form a container somewhat thicker than the plastic embodiment but collapsible for storage. In that event the lids 43 could be attached by Velcro or other fastening means.

Thus, this invention provides a sturdy, yet attractive, solution for maintaining sufficient water for cut trees which are mounted on tree stands of horizontal support members. Because this tree stand container has an opening which corresponds to the shape of the tree stand members the tree can be inserted into the container without removing it from the stand, which is a considerable advantage in setting up a tree for decorating. It is not necessary to undergo the frustration of removing the wooden tree stand and then painstakingly leveling the tree in a basin with radial prongs. If necessary, the tree can be levelled by placing discreet shims under a horizontal support member of the tree stand or under the horizontal bottom surface of a container segment, a process considerably easier than that involved in leveling a tree in a basin. Branches at the lower end of the tree can be removed, and if the tree has not been freshly cut, the bark can be notched to enhance the tree's ability to absorb water. The container can then be filled with water and covered with the lids. The tree can be decorated and presents placed around it, without fear that the tree will dry out or tip over. One segment can be left accessible to check the water level occasionally and to refill the container, if necessary, by sliding the lid off without disrupting the tree or the presents surrounding it.

Thus, this invention provides a container for the tree stand, as well as the tree, and one which is big enough to hold a sufficient amount of water that refilling is not usually necessary, yet the container is small enough that it does not take up a great deal of space under the tree. Its design with container segments makes it easy to check the water or refill it without disrupting the presents. The tree stand container of this invention also is designed to be easily manufactured because the container segments comprise the exterior of the container and lids can be easily fit to the individual segments without awkward fastening means. This tree stand container provides an attractive container which also allows substantial variations in design to fit a tree user's desires while disguising the appearance of the tree stand.

While it can be seen that the above-described invention will achieve all the advantages and objects attributed to it, and while it has been described in detail, it is not to be limited to such details except as may be necessitated by the appended claims.

We claim:

1. A portable container for holding water for a cut tree, wherein a tree is maintained in an upright position within said container by a tree base having horizontal support members disposed on the lower end of the tree, the container comprising a plurality of integrally connected container segments extending radially from a central portion of said container, each of said container segments having a generally rectangular shape with a horizontal bottom surface and side walls extending generally vertically from said bottom surface and tapered slightly outwardly therefrom, the side walls of said container segments being coextensive with exterior side walls of said container, said container forming a top opening to receive a tree base formed from horizontal support members and capable of maintaining said base and the lower end of a cut tree in water, said container having an inner watertight surface extending along said bottom surface and said side walls and further comprising a..plurality of removable lids disposed on the upper end of said side walls, each of said lids comprising a flat top surface shaped to substantially cover the top opening of one of said container segments and a flange depending downwardly along the outer edges of said top surface.

2. The container of claim 1 comprising at least three container segments.

3. The container of claim 1 wherein said container is generally cruciferous in shape.

4. The container of claim 1 wherein each container segment further comprises a solid, water impervious lid removably disposed on the upper end of said side walls.

5. The container of claim 1 wherein the flange disposed on the top surface of said lid is formed to fit snugly over the upper ends of said side walls of said container segments.

6. The container of claim 1 wherein each of said removable lids has an inner top surface with a width approximately equal to the outer width of the top opening formed by the side walls of the container segments, each of said lids having a flange depending downwardly from the top surface of said lid along its outer edges and extending below the upper end of the side walls of the container segment.

7. The container of claim 1 further comprising a base for a tree, said base comprising at least three horizontal radially extending support members removably mountable to a lower end of a cut tree, said support members disposed to fit through the opening in the container.

8. The container of claim 7 in which the base is formed in one piece of molded plastic and comprises fastening means for attachment to the lower end of a cut tree.

9. The container of claim 1 wherein the height of said side walls of said container segments from the bottom surface to the top opening is sufficient to hold water about the lower end of a cut tree mounted on horizontal support members disposed in said container.

10. A portable integral watertight container for holding water for a cut tree, wherein a tree is maintained in an upright position within said container by a tree base having horizontal support members disposed on the lower end of the tree, the container comprising at least three integrally connected container segments extending radially from a central portion of said container, each of said container segments being generally rectangular in shape and permanently connected to adjacent segments proximate said central portion, each of said segments having a generally horizontal bottom surface and side walls extending generally vertically from said bottom surface and slightly tapered outwardly therefrom to a top opening, the side walls of said container segments being coextensive with exterior side walls of said container, said container forming a top opening to receive a tree base formed from horizontal support members, said container being capable of maintaining said tree base and the lower end of a cut tree in water, said container further comprising a lid removably disposed on each container segment, said lid having an inner top surface with a width approximately equal to the outer width of the top opening formed by the side walls of the container segments, said lid having a flange depending downwardly from the top surface of said lid along its outer edges and extending below the upper end of the side walls of the container segment.

11. The container of claim 10 wherein said container is generally cruciferous in shape and is made of one piece from strong plastic.

12. A portable integral watertight container for holding water for a cut tree, wherein a tree is maintained in an upright position within said container by a tree base having horizontal support members disposed on the lower end of the tree, the container comprising at least three integrally connected container segments extending radially from a central portion of said container, each of said container segments being generally rectangular in shape and permanently connected to adjacent segments proximate said central portion, each of said segments having a generally horizontal bottom surface and side walls extending generally vertically from said bottom surface and slightly tapered outwardly therefrom to a top opening, the side walls of said container segments being coextensive with exterior side walls of said container, said container forming a top opening to receive a tree base formed from horizontal support members, said container being capable of maintaining said tree base and the lower end of a cut tree in water, said container further comprising a base for a tree, said base comprising horizontal radially extending support members removably mountable to a lower end of a cut tree, said support members disposed to fit through the opening in the container.

13. The container of claim 12 in which the base is formed in one piece of molded plastic and comprises fastening means for attachment to the lower end of a cut tree.

14. The container of claim 12 wherein a plurality of removable lids are disposed on the upper end of said side walls, each of said lids comprising a flat top surface shaped to substantially cover the top opening of one of said container segments and a flange depending downwardly along the outer edges of said top surface.

15. The container of claim 12 wherein the flange disposed on the top surface of said lid is formed to fit snugly over the upper ends of said side walls of said container segments.

* * * * *